US009761430B2

(12) United States Patent
Köster

(10) Patent No.: US 9,761,430 B2
(45) Date of Patent: Sep. 12, 2017

(54) FRAGMENT ION MASS SPECTRA MEASURED WITH TANDEM TIME-OF-FLIGHT MASS SPECTROMETERS

(71) Applicant: Bruker Daltonik GmbH, Bremen (DE)

(72) Inventor: Claus Köster, Lilienthal (DE)

( * ) Notice: Subject to any disclaimer, the term of this patent is extended or adjusted under 35 U.S.C. 154(b) by 0 days.

(21) Appl. No.: 15/014,091

(22) Filed: Feb. 3, 2016

(65) Prior Publication Data

US 2016/0225592 A1 Aug. 4, 2016

(30) Foreign Application Priority Data

Feb. 4, 2015 (DE) ..... 10 2015 101 567

(51) Int. Cl.
*H01J 49/40* (2006.01)
*H01J 49/00* (2006.01)

(52) U.S. Cl.
CPC ..... *H01J 49/40* (2013.01); *H01J 49/0027* (2013.01); *H01J 49/0045* (2013.01)

(58) Field of Classification Search
CPC ..... H01J 49/0036; H01J 49/405; H01J 49/34; H01J 49/40
USPC ..... 250/281, 282, 283, 286, 287, 288
See application file for complete search history.

(56) References Cited

U.S. PATENT DOCUMENTS

2004/0222369 A1 11/2004 Makarov et al.
2005/0098721 A1 5/2005 Bateman et al.
2009/0294642 A1* 12/2009 Brown ..... H01J 49/0031 250/282

FOREIGN PATENT DOCUMENTS

DE 19856014 C2 12/2000
DE 102013011462 A1 1/2015
WO 9533279 A1 12/1995
WO 2015003799 A1 1/2015

OTHER PUBLICATIONS

L'Hermite et al., A new method to study metastable fragmentation of clusters using a reflectron time-of-flight mass spectrometer, Review of Scientific Instruments, vol. 71, No. 5, May 2000.
Kenny et al., A Parallel Approach to Post Source Decay MALDI-TOF Analysis, Journal of the American Society for Mass Spectrometry, vol. 17, Jan. 2006.

* cited by examiner

*Primary Examiner* — Nicole Ippolito
(74) *Attorney, Agent, or Firm* — Benoit & Côté Inc.

(57) ABSTRACT

The present invention provides a method for acquiring fragment ion mass spectra with a time-of-flight mass spectrometer, whereby mixed mass spectra with fragment ions of different parent ion species are acquired and compared with each other in such a way that the signals of those fragment ions which originate from the same parent ion species are determined. The time-of-flight mass spectrometer contains an ion source, a flight path, a reflector and an ion detector. The flight path is preferably field-free and is positioned before the reflector, and the reflector preferably has a quadratically increasing reflection potential.

21 Claims, 4 Drawing Sheets

FRAGMENT ION MASS SPECTRA MEASURED WITH TANDEM TIME-OF-FLIGHT MASS SPECTROMETERS

BACKGROUND OF THE INVENTION

Field of the Invention

The invention relates to the mass spectrometric measurement of fragment ions with tandem time-of-flight mass spectrometers.

Description of the Related Art

Note: Instead of the statutory "unified atomic mass unit" (u), this document uses the "dalton" (Da), which was added in the last (eighth) edition of the document "The International System of Units (SI)" of the "Bureau International des Poids et Mesures" in 2006 on an equal footing with the atomic mass unit. As is noted there, this was done primarily in order to allow use of the units kilodalton, millidalton and similar.

Mass spectrometers can usually only determine the ratio of the ion mass to the charge of the ion. In the following, the term "mass of an ion" or "ion mass" can also refer to the ratio of the mass m to the number z of excess positive or negative elementary charges of the ion, i.e. the mass-to-elementary charge ratio (or mass-to-charge ratio, for short) m/z.

In the application document DE 10 2013 011 462.4 (C. Köster), which is to be included here by reference, time-of-flight mass spectrometers are described which have one or more Cassini reflectors instead of the usual Mamyrin reflectors. The prior art is also described in detail in this publication.

The term "fragment ion mass spectrum" or "daughter ion mass spectrum" usually refers to a mass spectrum of the fragment ions of a selected ionic species, while the ionic species selected for the fragmentation is usually called "parent ions".

In time-of-flight mass spectrometers with ionization by matrix-assisted laser desorption (MALDI), a distinction is made between two types of fragmentation for the production of daughter ions—ISD fragmentation ("in-source decay") and PSD fragmentation ("post-source decomposition"). To acquire daughter ion mass spectra by means of PSD, the energy of the laser pulses used for MALDI can be increased to the extent that, during the MALDI process, many metastable analyte ions are produced which decay into fragment ions (daughter ions) only after a first acceleration region, but before a reflector. It is also possible to produce unstable parent ions by means of collisions in a gas-filled collision chamber positioned between the first acceleration region and the reflector. In both cases, the parent ions for which a daughter ion mass spectrum is to be acquired have to be selected. The parent ions are usually selected using a parent ion selector which is positioned after the first acceleration region and before the reflector, and before the collision chamber, if there is one. If metastable parent ions have already decomposed between the first acceleration region and the parent ion selector, the fragment ions already formed here can also pass through the parent ion selector because they have essentially the same speed as the undecomposed parent ions, and therefore arrive at the parent ion selector at the same time as the undecomposed parent ions. The undecomposed parent ions and the daughter ions formed from the selected parent ions usually pass through a second acceleration region before they are separated in the reflector and measured as a daughter ion mass spectrum. Time of flight mass spectrometers and appropriate methods to acquire PSD daughter ion mass spectra are described in patent document DE 198 56 014 C2 (C. Köster et al., corresponding to GB 2 344 454 B and U.S. Pat. No. 6,300,627 B1), for example.

The acquisition of daughter ion mass spectra with ionization by matrix-assisted laser desorption (MALDI) consumes relatively large amounts of sample material. For PSD fragmentation, the energy of the laser pulses is greatly increased, thus at the same time increasing the sample consumption, in order to produce large numbers of metastable ions which are to decompose in a first straight flight path before the reflector. Furthermore, a separate daughter ion mass spectrum will also be acquired for each parent ion species selected. It is obviously a disadvantage that the restriction to one single parent ion species in each case means that many other ionic species are filtered out unused, thus causing relatively large amounts of sample to be consumed if several daughter ion mass spectra are to be measured. It is also disadvantageous that the acquisition of several daughter ion mass spectra has to be conducted sequentially, which requires longer measuring times.

An objective of the invention is to provide methods with which time-of-flight mass spectra of fragment ions are acquired quickly and with low sample consumption, in particular by ionization with matrix-assisted laser desorption (MALDI).

SUMMARY OF THE INVENTION

The invention provides methods for the mass spectrometric measurement of fragment ions with a time-of-flight mass spectrometer which contains an ion source, a flight path, a reflector and an ion detector.

A first method according to the invention is characterized by the fact that (a) at least two mixed time-of-flight spectra are acquired with different instrument parameters in each case, where the mixed time-of-flight spectra contain signals of fragment ions of more than one parent ion species, and the fragment ions are produced on the flight path before the reflector; and that (b1) the mixed time-of-flight spectra are compared with each other, and the signals of those fragment ions which originated from one parent ion species are identified; and/or (b2) the times of flight of one fragment ion species are determined in the mixed time-of-flight spectra, and the mass-to-charge ratios of the fragment ion and the associated parent ion are calculated from this. If the charges of the fragment ion and the parent ion are known, the "real" masses can be determined. The instrument parameter that is changed can, for example, be the accelerating voltage on an acceleration region before the flight path, or the decelerating voltage at the reflector, or both.

In the event that one or more mixed time-of-flight spectra also contain signals of the parent ions, the signals of those fragment ions which originate from one parent ion species can be assigned to the corresponding parent ion species by comparing the mixed time-of-flight spectra. The signals of the fragment ions which have been identified as originating from one parent ion species can be transferred together with the signal of the parent ion species, but also without the signal of the parent ion species, into a "demixed" pure fragment ion mass spectrum.

The mass-to-charge ratio of the fragment ion and the associated parent ion can be calculated by selecting one signal which originated from the same fragment ion species in each of two mixed time-of-flight spectra, and determining the mass-to-charge ratios as the solution of the following equations:

$$T_1=\mathrm{Sys}(m/q_m, M/q_M, P_1) \quad (1)$$

$$T_2=\mathrm{Sys}(m/q_m, M/q_M, P_2) \quad (2)$$

where M and $q_M$ are the mass and the charge of the parent ion, respectively; m and $q_m$ the mass and the charge of the fragment ion, respectively; $T_1$ and $T_2$ the times of flight determined from the mixed time-of-flight spectra of the two signals of the fragment ion species; $P_1$ and $P_2$ the values of the changed instrument parameter which are used in the acquisition of the time-of-flight spectra; and Sys is the system function of the time-of-flight mass spectrometer which gives the time of flight of a fragment ion as a function of the instrument parameter and the mass-to-charge ratios of the fragment ion and the associated parent ion.

A further possibility to calculate the mass-to-charge ratio of the fragment ion and the associated parent ion consists in selecting one signal which originates from the same fragment ion species in each of several mixed time-of-flight spectra, and determining the mass-to-charge ratios as parameters of a regression for $T_i=\mathrm{Sys}(m/q_m, M/q_M, P_i)$. Here, M and $q_M$ are the mass and the charge of the parent ion, respectively; m and $q_m$ the mass and charge of the fragment ion, respectively; $T_i$ the times of flight of the signals of the fragment ion species determined from the mixed time-of-flight spectra; and $P_i$ the values of the instrument parameter which are used to acquire the time-of-flight spectra. The system function of the time-of-flight mass spectrometer Sys gives the time of flight of a fragment ion as a function of the instrument parameter and the mass-to-charge ratio of the fragment ion and the associated parent ion.

A second method according to the invention is characterized by the fact that (a) a mixed time-of-flight spectrum is acquired which contains signals of fragment ions of more than one parent ion species, where the fragment ions are produced on the flight path before the reflector; that (b) two signals $S_1$ and $S_2$ in the isotopic pattern of one fragment ion are selected, their times of flight $T_1$ and $T_2$ being determined from the mixed time-of-flight spectrum; and that (c) the mass-to-charge ratios of the fragment ion and the associated parent ion are determined as the solution of the equations below:

$$T_1=\mathrm{Sys}(m/q_m, M/q_M) \tag{3}$$

$$T_2=\mathrm{Sys}((m+n\cdot\mathrm{Da})/q_m, (M+n\cdot\mathrm{Da})/q_M) \tag{4}$$

where M and $q_M$ are the mass and the charge of the parent ion, respectively; m and $q_m$ the mass and the charge of the fragment ion, respectively; the selected isotopes have a mass difference of n dalton; and Sys is the system function of the time-of-flight mass spectrometer which gives the time of flight of a fragment ion as a function of the mass-to-charge ratios of the fragment ion and the associated parent ion. If the charges of the fragment ion and the associated parent ion are known, the "real" masses m and M can be determined. The method according to the invention requires a relatively long time of flight in order to resolve the isotopic pattern despite the decomposition energy which the fragment ions will receive as they are generated (especially when metastable parent ions decompose) in a statistically distributed direction.

The several parent ion species can be selected from a larger number of ionic species, e.g., between the ion source and the flight path or within the field-free flight path before the fragment ions form or are created. There is no need to select one single parent ion species.

The parent ions are accelerated before entering the flight path, for example in the ion source itself or in an acceleration region which is positioned between the ion source and the flight path. The time of flight of the ions usually starts with the pulsed switching on of an accelerating field. The fragment ions can form in the flight path through the decomposition of metastable parent ions and/or can be generated there from the parent ions in a fragmentation cell. The parent ions and their fragment ions preferably have the same time of flight up to the reflector, but pass through the reflector with different times of flight. The reflector preferably has a quadratically increasing deceleration potential, in particular the potential distribution of a Cassini ion trap for decoupled oscillations of the ions in the longitudinal and the lateral directions. After the reflector, the ions can pass through a second acceleration region or a second flight path, which are preferably shorter than the flight path before the reflector, before being detected in the ion detector.

The acquisition of a mixed time-of-flight spectrum can mean that the masses of the ion signals no longer increase monotonically along the time-of-flight axis, i.e., that the fragment ions of a first parent ion species may have a longer time of flight than other parent ions or fragment ions of a second heavier parent ion species, and therefore the time-of-flight axis cannot be directly transformed into a mass axis. From one single signal of a fragment ion, it is not possible to determine its charge-related mass or the charge-related mass of the associated parent ion.

If the total flight path of the time-of-flight mass spectrometer essentially consists of a field-free flight path before the reflector, and if the reflector has a quadratically increasing deceleration potential, the system function is given by:

$$T(M_p, m_{p,d}) = c_1 \cdot \sqrt{\frac{M_p}{2q_M U_B}} + c_2 \cdot \sqrt{\frac{m_{p,d}}{2q_m U_C}} \tag{5}$$

where $m_{p,d}$ and $q_m$ are the mass and the charge of a fragment ion, respectively; $M_p$ and $q_M$ the mass and the charge of the associated parent ion, respectively; $U_B$ is the accelerating voltage of an acceleration region before the field-free flight path; and $U_C$ is the decelerating voltage at the reflector. The two constants $c_1$ and $c_2$ can be determined by a calibration with one or more known substances.

If two mixed time-of-flight spectra are acquired with different accelerating voltages $U_{B1}$ and $U_{B2}$, the following equations for the times of flight of the fragment ions are obtained:

$$T_1(M_p, m_{p,d}) = c_1 \cdot \sqrt{\frac{M_p}{2q_M U_{B1}}} + c_2 \cdot \sqrt{\frac{m_{p,d}}{2q_m U_C}} \tag{6}$$

$$T_1(M_p, m_{p,d}) = c_1 \cdot \sqrt{\frac{M_p}{2q_M U_{B2}}} + c_2 \cdot \sqrt{\frac{m_{p,d}}{2q_m U_C}} \tag{7}$$

The quadratic decelerating potential in combination with the field-free flight path is advantageous because the fragment ions which originate from one parent ion species can easily be identified from the two measured mixed time-of-flight spectra. As can be seen from the two equations, all the fragment ions of masses $m_{p,d}$ (where d=1, 2, 3 . . . ) of the parent ion species with mass $M_p$ (and the parent ions themselves) have the same time-of-flight delay $\Delta T=T_2-T_1$, which depends only on the mass-to-charge ratio $M_p/q_M$ of the parent ions and the two accelerating voltages:

$$\Delta T = T_2 - T_1 = c_1\sqrt{\frac{M_p}{2q_M}}\left(\sqrt{\frac{1}{U_{B2}}} - \sqrt{\frac{1}{U_{B1}}}\right) \quad (8)$$

All the signals of the second mixed time-of-flight spectrum which have the same time-of-flight delay ΔT as the first mixed time-of-flight spectrum are identified as originating from one parent ion species. The mass $M_p$ of the parent ion species here can be determined directly from the time-of-flight delay and the accelerating voltages $U_{B1}$ and $U_{B2}$. The time-of-flight delays of the fragment ions which originate from different parent ion species ($\Delta T(M_1)$, $\Delta T(M_2)$, . . . ) can also be determined by a cross correlation between the first and the second mixed time-of-flight spectra. The signals of the daughter ions which originate from one parent ion species can be identified as being those signals which overlap in the two mixed frequency spectra at one of the time-of-flight delays determined. Moreover, since the sequence of the daughter ions of a parent ion species is retained in the two mixed time-of-flight spectra, it is easy to find two signals S1 and S2 in the mixed time-of-flight spectra which each originate from the same daughter ion species.

It is also possible to acquire two mixed time-of-flight spectra with different accelerating voltages $U_{B1}$ and $U_{B2}$ which contain signals of the parent ions also. In the second mixed time-of-flight spectrum, those signals are then identified which have the same time-of-flight delay ΔT as the first mixed time-of-flight spectrum. The signal with the longest time of flight is assigned to the parent ion species, and the other signals are assigned to the fragment ions which originate from this parent ion species.

It is advantageous to acquire at least one time-of-flight spectrum without fragment ions in addition to the mixed time-of-flight spectrum or spectra in order to directly identify those parent ions in the mixed time-of-flight spectra which have not decomposed or fragmented and to distinguish them from daughter ions. It is also possible to additionally acquire two time-of-flight spectra at the accelerating voltages $U_{B1}$ and $U_{B2}$ which contain only signals of parent ions. The signals in the second mixed time-of-flight spectrum which have the same time-of-flight delay ΔT as the first mixed time-of-flight spectrum are then assigned to the parent ion species which has the same time-of-flight delay ΔT in the additionally acquired time-of-flight spectra.

It is preferable to use an ion source in which the ions are generated by ionization by matrix-assisted laser desorption (MALDI). The MALDI ion source preferably directly adjoins a field-free flight path in this case. The ions are then usually accelerated axially from the MALDI ion source into the field-free flight path. In the MALDI ion source, the samples can, as usual, absorb so much internal energy by being bombarded with laser pulses at high pulse energy that at least some of the ions produced are metastable and decompose into fragment ions on the flight path before the reflector. In addition, a time-of-flight mass spectrum can be acquired at low pulse energy so that few or no metastable parent ions are produced and the spectrum only contains all the ions of masses $M_1$, $M_2$, $M_2$ etc. which are possible parent ions.

DETAILED DESCRIPTION

The present invention provides a method for the fast acquisition of daughter ion mass spectra with low sample consumption, whereby a time-of-flight mass spectrometer is used to acquire mixed time-of-flight spectra from large numbers of parent and fragment ions in such a way that it is possible to use mathematical and geometrical relationships to determine which fragment ions originate from which parent ion species in each case. The time-of-flight mass spectrometer contains an ion source, a flight path, a reflector and an ion detector. The flight path is preferably field-free and the reflector preferably has a quadratically increasing reflection potential.

Figure 1:
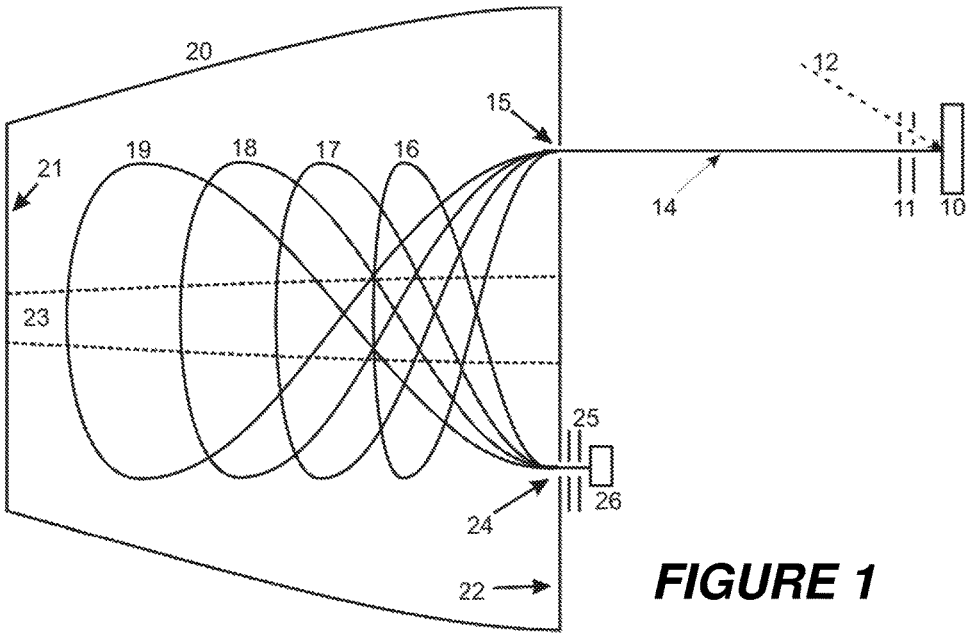
FIG. 1 shows a schematic simplification of a time-of-flight mass spectrometer with a MALDI ion source and a Cassini reflector (20, 21, 22, 23), with which mixed time-of-flight spectra with several parent ion species and multiple fragment ions are acquired.

FIG. 1 shows a schematic simplification of a time-of-flight mass spectrometer which comprises a MALDI ion source (10, 11, 12), a field-free flight path (14), a Cassini reflector (20, 21, 22, 23), and an ion detector (26).

The sample plate (10) holds a multiplicity of samples, each with a mixture of substances, which are ionized by a UV light pulse (12) with the aid of matrix assisted laser desorption/ionization (MALDI). Bombarding the plate with the UV light pulse (12) allows parent ions to be produced whose internal energy is so high (called "metastable ions") that at least some of them decompose into fragment ions on the field-free flight path after the accelerating electrodes (11). The ions can be accelerated in the MALDI ion source with a time delay so that ions of the same mass are time-focused at the inlet (15) in each case (focusing by "delayed extraction"). Some of the metastable parent ions of the different substances decompose along the field-free flight path (14); the fragment ions have approximately the same speed as the parent ions and thus enter the Cassini reflector (20, 21, 22, 23) at the same time. The parent and fragment ions pass through the Cassini reflector (20, 21, 22, 23) on different trajectories (16, 17, 18, 19) with different times of flight, however. The lower kinetic energy of the fragment ions (16, 17, 18) means that they do not penetrate as deeply into the Cassini reflector as the parent ions (19), and their lower mass means they pass through the Cassini reflector (20, 21, 22, 23) at a correspondingly faster speed. Both the fragment ions and the parent ions are spatially focused onto the exit aperture (24), however. Both parent ions and fragment ions are accelerated in an acceleration region (25) (diaphragm stack) in a very short time to a high energy, typically between 10 and 30 keV, and measured in the ion detector (26) as a mixed mass spectrum of parent and fragment ions.

Parent and fragment ions have the same time of flight up to the Cassini reflector (20, 21, 22, 23), but are temporally focused in the Cassini reflector (20, 21, 22, 23) with different times of flight so that the ion detector (26) measures a "mixed time-of-flight spectrum" which contains several species of parent ions as well as their fragment ions.

The Cassini reflector (20, 21, 22, 23) is shown in cross-section. The ion trajectories are located between the two inner electrodes (23), which are shown as broken lines because they are outside the plane of the drawing. The Cassini reflector here consists of an outer shell electrode (20), two inner electrodes (23) and two terminating equipotential plates (21, 22) as described in publication DE 10 2013 011 462 A1. The Cassini reflector (20, 21, 22, 23) has the potential distribution of half a Cassini ion trap, the increase in the potential being precisely quadratic in the axial direction. The equipotential plates (21, 22) have electrodes in the form of curved lines which follow the equipotential surfaces of the potential distribution of the Cassini ion trap at the location of the equipotential plate. The equipotential plate (22) has two apertures (15, 24) for the injection and ejection of ions, while the shape of the Cassini reflector (20, 21, 22, 23) and the positions of the injection and ejection apertures (15, 24) are preferably designed so that ions with the same mass pass through an odd, whole number of transverse half oscillations in the Cassini reflector (20, 21, 22, 23). In FIG. 1, the ions pass through 3/2 transverse oscillations in the Cassini reflector (20, 21, 22, 23). It is also possible to build Cassini reflectors which are even slimmer and which have greater penetration depths into the parabolic potential in the longitudinal direction. The ions must then execute 5/2, 7/2 or 9/2 transverse oscillations per half a longitudinal oscillation, which increases the acceptance for fragment ions of very different mass m.

The potential distribution $\Psi(x, y, z)$ of a Cassini ion trap can, for example, have the form of a hyperlogarithmic field:

$$\psi(x, y, z) = \ln\left[\frac{(x^2+y^2)^2 - 2\cdot b^2\cdot(x^2-y^2) + b^4}{ai^4}\right]\cdot \frac{U_{ln}}{C_{ln}} + [-(1-B)\cdot x^2 - B - y^2 + z^2] - \frac{U_{quad}}{C_{quad}} + U_{off}$$

The shape of the field can be changed by the constants ai, b and B. $U_{ln}$, $U_{quad}$ and $U_{off}$ are potential voltages, $C_{ln}$ and $C_{quad}$ are constants. The inner surface of the outer housing (20) and the outer surfaces of the inner electrodes (23) are equipotential surfaces $\Psi(x, y, z)$=const. of this potential distribution. In cross-section, the equipotential lines form approximate Cassini ovals about the inner electrodes here; two inner electrodes (23) result in Cassini ovals of the second order; n inner electrodes result in Cassini ovals of the nth order. For an even number of inner electrodes, there are embodiments where the ions can oscillate transversely near the center plane between at least one pair of inner electrodes. Form parameters can be used to set any chosen ratio between the longitudinal oscillation period and the transverse oscillation period.

A Cassini reflector is most preferable here because it has a quadratically increasing decelerating potential (reflection potential) and also spatially focuses the ions in both lateral directions. Additionally, fragment ions which are formed in the reflector by decomposition are almost completely filtered out. In principle, however, any reflector with a quadratically increasing potential can be used to obtain the preferred simple system function in accordance with Equation (5). However, it should furthermore be noted here that a time-of-flight mass spectrometer with a Mamyrin reflector can also be used to acquire mixed time-of-flight spectra according to the invention, although the system function is different from Equation (5) when a reflector without quadratic decelerating potential is used, and solving the corresponding system of equations can be more complicated.

Figure 2:
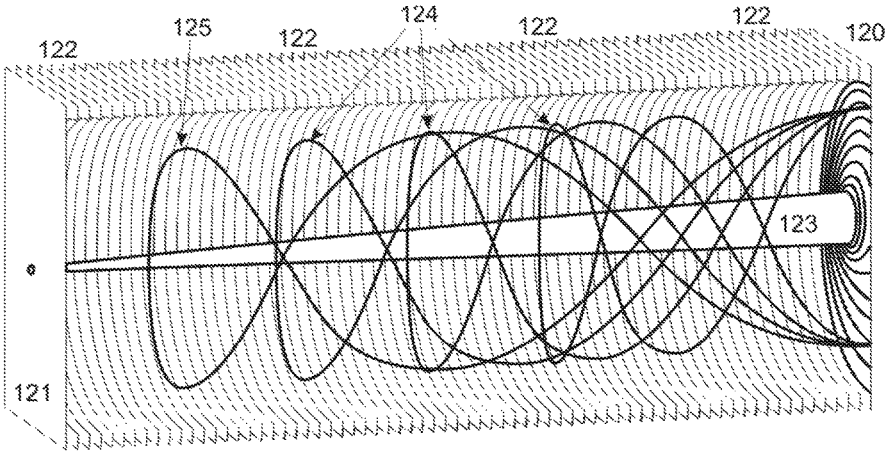
FIG. 2 shows a Cassini reflector of a different design with which the electric field of the Cassini reflector (20) can be generated.

The outer housing (20) of the Cassini reflector in FIG. 1 is quite difficult to manufacture. Moreover, the interior of the largely closed Cassini reflector is not easy to evacuate. FIG. 2 shows a Cassini reflector of a different design but with the same electric field: The outer housing (20) in FIG. 1 is replaced here by a stack of identical apertured diaphragms (122). The Cassini reflector is shown here in three dimensions; it is cut open in the reflection direction and only half the detector is shown. The apertured diaphragms have inner openings in the form of a Cassini oval. In order to maintain the electric field of a Cassini ion trap, the apertured diaphragms (122) and the electrodes of the equipotential plate (120) are supplied with suitable potentials which produce the quadratically increasing field. The equipotential plates (120) and (121) correspond to those in FIG. 1. Fragment ions of different masses m move on trajectories (124) which extend into the reflector to different depths. The parent ions move on a trajectory (125) which extends deeper into the reflector. This embodiment has several advantages: The reflector is easier to evacuate; the overall size is smaller, the manufacture is simpler and less expensive.

Figure 3:
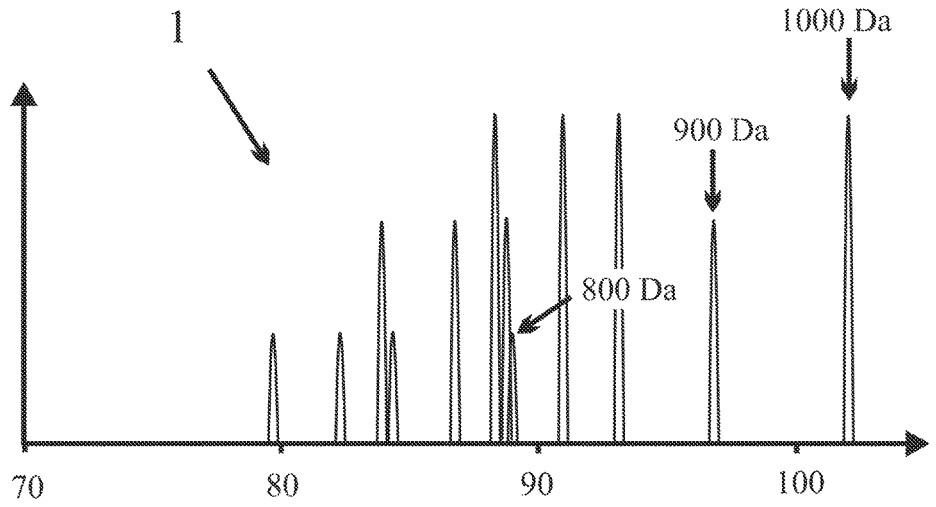
FIGS. 3 and 4 show two artificial mixed time-of-flight spectra (1, 2), which contain signals from three parent ion species with masses of 800, 900 and 1000 daltons and their fragment ions.
Figure 4:
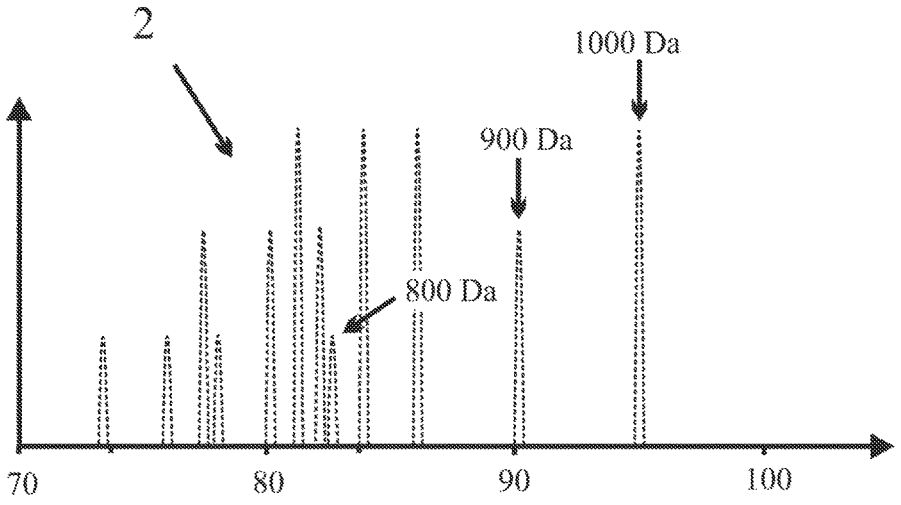

FIGS. 3 and 4 show two mixed time-of-flight spectra (1, 2), as they are acquired with a time-of-flight mass spectrometer from FIG. 1 at two different accelerating voltages $U_1$ and $U_2$ in the MALDI ion source (10, 11, 12). In the two mixed time-of-flight spectra (1, 2), the parent ions are labeled by arrows and have a mass of 800, 900 and 1000 daltons. For each of these parent ion species there exist three fragment ions with masses of 100, 200 and 300 daltons, which are each plotted with the intensity of the associated parent ion species. The abscissa indicates the times of flight.

The parent ions and their associated fragment ions have the same time of flight on the straight field-free flight path (14), but different times of flight in the Cassini reflector (20, 21, 22, 23). If the two mixed time-of-flight spectra are acquired with two different accelerating voltages $U_1$ and $U_2$, then for fragment ions, a total time of flight $t_1$ results in the mixed time-of-flight spectrum 1 and a total time of flight $t_2$ in the mixed time-of-flight spectrum 2:

$$t_1(M_p, m_d) = c_1\cdot\sqrt{\frac{M_p}{2q_M U_1}} + c_2\cdot\sqrt{\frac{m_d}{2q_m U_C}}$$

$$t_2(M_p, m_d) = c_1\cdot\sqrt{\frac{M_p}{2q_M U_2}} + c_2\cdot\sqrt{\frac{m_d}{2q_m U_C}}.$$

where $M_p$ is the mass of the parent ions (with p=1, 2, . . . ), $m_d$ the mass of an associated fragment ion (with d=1, 2, . . . ), $q_M$ and $q_m$ their charges, $U_1$ the accelerating voltage for the parent ions in the MALDI ion source (10, 11, 12), and $U_C$ the decelerating voltage at the Cassini reflector (20, 21, 22, 23). The two constants $c_1$ and $c_2$ can be determined by calibrating with known substances. For MALDI ions, the charges $q_M$ and $q_m$ are usually the charges of individual protons.

If the times of flight $t_1$ and $t_2$ for one fragment ion species in the two mixed time-of-flight spectra (1, 2) are known, the mass of the associated parent ion $M_p$ can be determined:

$$\frac{M_p}{q_M} = \frac{t_1 - t_2}{c_1} \cdot \frac{\sqrt{2 \cdot U_1 \cdot U_2}}{\sqrt{U_2} - \sqrt{U_1}}$$

and from this, the mass of the fragment ion $m_d$ can be determined:

$$\frac{m_d}{q_m}\left\{\frac{t_1}{c_2} - \frac{c_1}{c_2} \cdot \sqrt{\frac{M}{2q_M U_1}}\right\}^2 \cdot 2 \cdot U_C.$$

If the ions pass through the Cassini reflector in FIG. 1 with relatively low energy, for example with only 300 electron-volts, the long time of flight results in a relatively high resolution, which means that the isotopic lines can be resolved for the fragment ions also, despite the decomposition energy which they received in statistically distributed directions during the decomposition. If, for example, the $^{13}C$ signal and the $^{12}C$ signal of a fragment ion species are resolved in an individual mixed time-of-flight spectrum which is acquired with a time-of-flight mass spectrometer according to FIG. 1, the two equations below with the unknown masses of the parent ion and the fragment ion are obtained:

$$t_1(M_p, m_{p,d}) = c_1 \cdot \sqrt{\frac{M_p}{2q_M U_B}} + c_2 \cdot \sqrt{\frac{m_{p,d}}{2q_m U_C}}$$

$$t_2(M_p + 1, m_{p,d} + 1) = c_1 \cdot \sqrt{\frac{M_p + 1}{2q_M U_B}} + c_2 \cdot \sqrt{\frac{m_{p,d} + 1}{2q_m U_C}}$$

where $m_{p,d}$ and $q_m$ are the mass and the charge of the daughter ion, respectively; $M_p$ and $q_M$ the mass and the charge of the associated parent ion, respectively; $U_B$ the accelerating voltage for the parent ions in the MALDI ion source, and $U_C$ the decelerating voltage at the reflector. The two constants $c_1$ and $c_2$ can be determined by calibrating with a known substance. The two unknown masses are obtained as the solution of the system of equations. This method according to the invention requires a good time-of-flight resolution, but it is not necessary to acquire a second mixed time-of-flight spectrum with a different accelerating voltage.

The two mixed time-of-flight spectra (1) and (2) can also be compared with each other in order to identify the signals of those fragment ions which originate from one parent ion species. The comparison can be a geometric one or be undertaken with the aid of a cross correlation, for example. In the two mixed time-of-flight spectra (1, 2), the parent ions as well as all the associated fragment ions are delayed by the same value of the time of flight $t_1 - t_2$, since the times of flight in the Cassini reflector (20, 21, 22, 23) remain the same for the parent ions and their fragment ions for the two accelerating voltages and only the times of flight of the straight flight path (14) are different. To now be able to easily recognize which fragment ions originate from which parent ions, three superpositions of the mixed time-of-flight spectrum (1) from FIG. 3 are drawn in FIGS. 5, 6 and 7 with the respective delayed mixed time-of-flight spectra (2) from FIG. 4. The mixed time-of-flight spectrum from FIG. 4 is shifted along the time-of-flight axis until either the parent ions with a mass of 800 daltons or those with a mass of 900 daltons, or those with a mass of 1000 daltons are positioned opposite each other.

Figure 5:
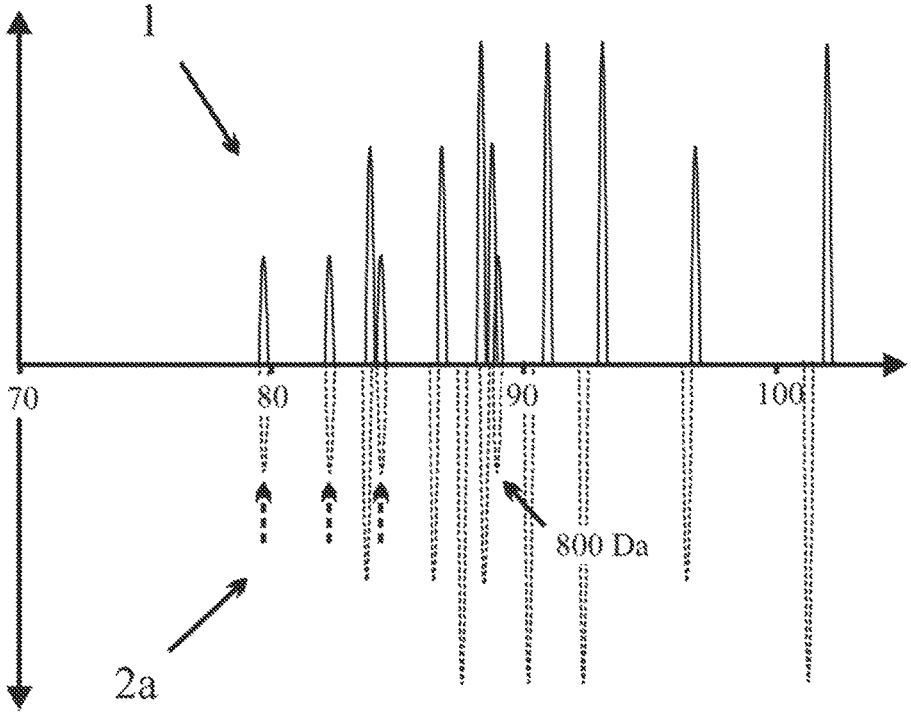
FIGS. 5, 6 and 7 show superpositions of the mixed time-of-flight spectra (1, 2) from FIGS. 3 and 4, where the mixed time-of-flight spectrum (2) is shifted in each case to such an extent that the signals of one of the three parent ion species are opposite each other in both mixed time-of-flight spectra.

In FIG. 5, the parent ions with a mass of 800 daltons in the mixed time-of-flight spectra (1) and (2*a*) coincide; it is also easy to recognize here that, at the same time, all the fragment ions of these parent ions coincide with each other (dashed arrows) and so are easily discernible as associated fragment ions. In the same way, it is also possible to identify the fragment ions of the parent ions with masses of 900 and 1000 daltons when the mixed time-of-flight spectra (1) and (2*b*) or (1) and (2*c*) in FIGS. 6 and 7 are compared.

Figure 6:
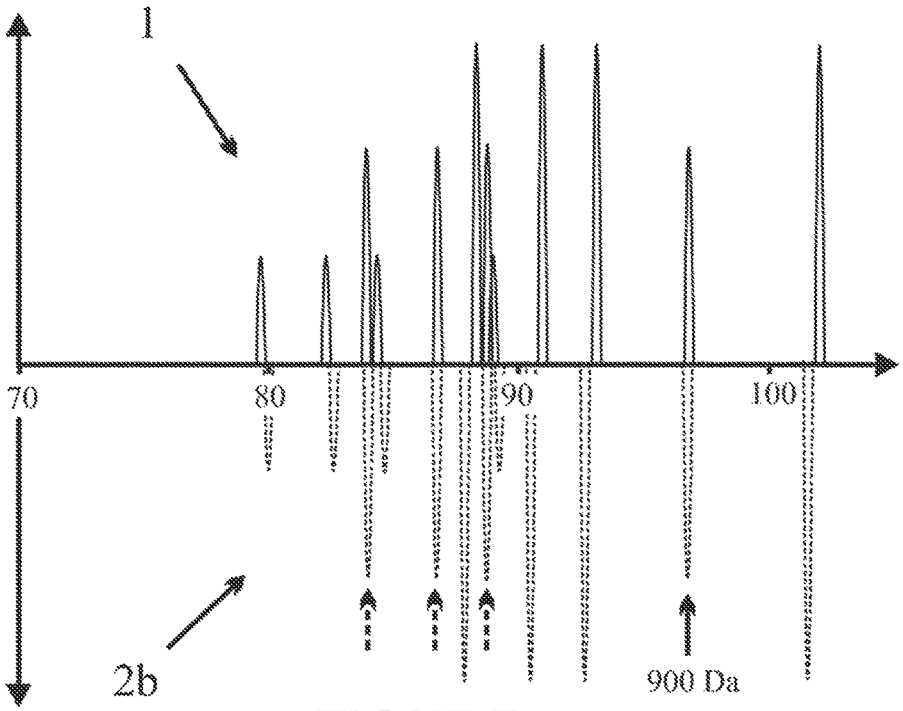
Figure 7:
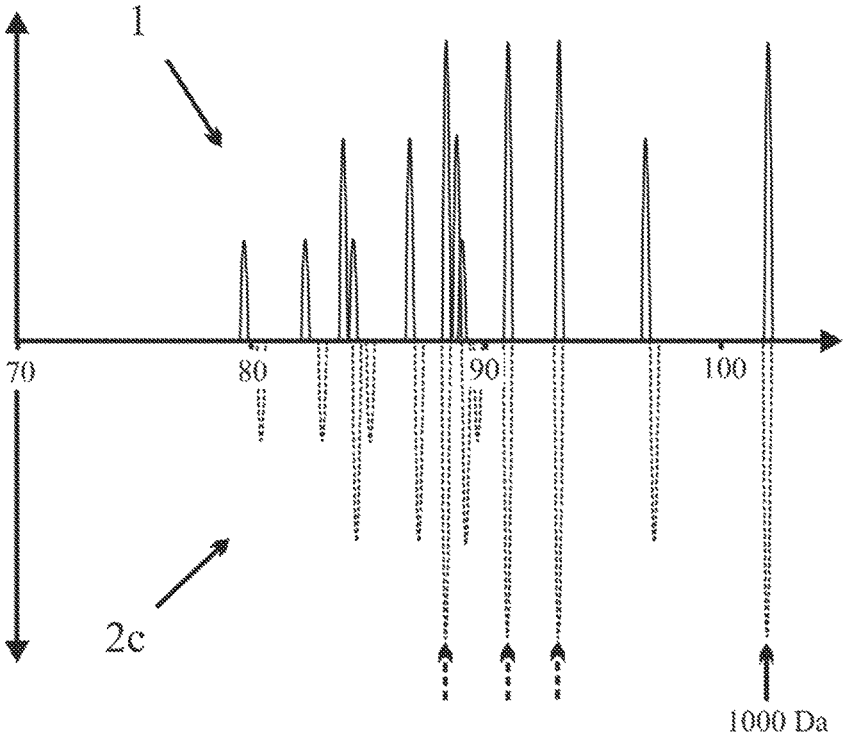

The three delay times which are used to shift the mixed time-of-flight spectra (2*a*, 2*b*, 2*c*) in FIGS. 5 to 7 can also be determined with the aid of a cross correlation between the mixed time-of-flight spectra (1) and (2), the cross correlation having a local maximum at each of the three delay times. A pure fragment ion spectrum is obtained by selecting those signals from a mixed time-of-flight spectrum which are all delayed by one of the correspondingly determined times.

It is advantageous to first acquire a conventional time-of-flight spectrum of the parent ions without fragment ions by using a low laser energy. It contains all the ions of masses $M_1$, $M_2$, $M_2$ etc. which are possible parent ions. If two time-of-flight spectra of the parent ions are acquired for the two accelerating voltages that are also used for the two mixed time-of-flight spectra (1) and (2), then the parent ions in the two mixed time-of-flight spectra (1) and (2) can be identified. The time delays which are characteristic of the respective parent ions and their fragment ions can also be determined from a cross correlation of the two time-of-flight spectra of the parent ions. If the time-of-flight spectrum of the parent ions contains too many parent ions, each of which can decompose into fragment ions, for example over fifty possible parent ions, a conventional parent ion separator can be used to select a mass range of parent ions, for example the mass range between 1000 and 1500 daltons, in order to limit the number of parent ions, for example to only fifteen parent ions per mixed time-of-flight spectrum. All of the fifty or so daughter ion mass spectra can be determined in this way using around four to five mixed time-of-flight spectra. The sample consumption is therefore reduced by a factor of ten compared to the methods previously used.

Figure 8:
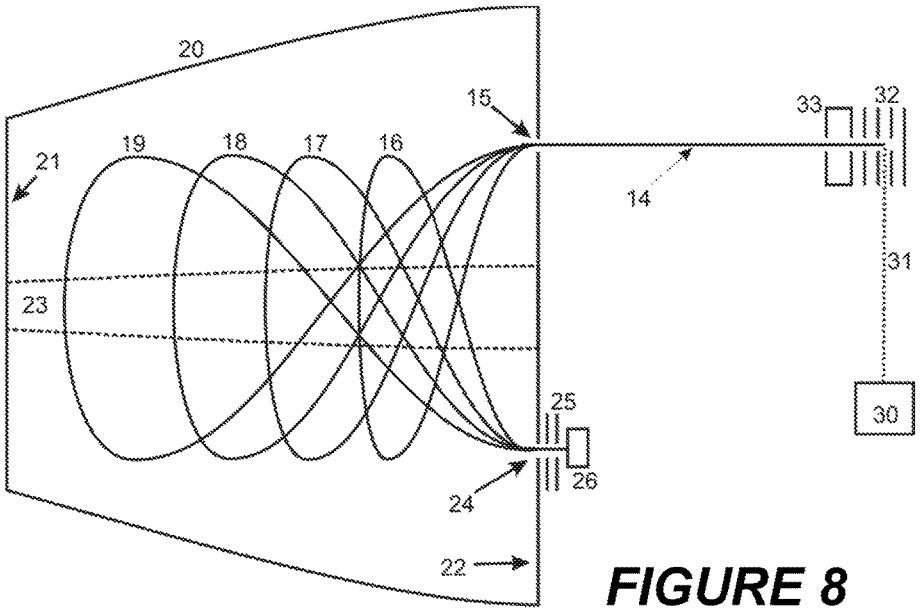
FIG. 8 shows a time-of-flight mass spectrometer with orthogonal acceleration of an ion beam (31) from an ion source (30) in a schematic simplification.

FIG. 8 is a schematic simplification showing a time-of-flight mass spectrometer with a pulser (32) for the orthogonal acceleration of an ion beam (31) from an ion source (30). Ion source (30) and ion beam (31) are drawn in the projection plane here for clarity; they should be positioned at right angles to the projection plane, however, in order to generate a band-shaped ion beam (14) which can enter the Cassini reflector (20, 21, 22, 23) through a slit (15) extending perpendicular to the projection plane. The parent ions of the pulsed-out beam pass through a fragmentation cell (33) and decompose either directly at this location or on the field-free flight path (14) into fragment ions of the mixed time-of-flight spectra. The fragmentation in the fragmentation cell (33) can be brought about by photons of sufficient energy or by collisions in the gas-filled fragmentation cell (33), for example.

The person skilled in the art will find it easy to develop further interesting embodiments based on the devices for the reflection of ions according to the invention. These shall also be covered by this patent protection application to the extent that they derive from this invention.

The invention claimed is:

1. A method for the mass spectrometric measurement of fragment ions with a time-of-flight mass spectrometer which contains an ion source, a flight path, a reflector and an ion detector, wherein (a) at least two mixed time-of-flight spectra are acquired with an instrument parameter which is different in each case, the mixed time-of-flight spectra containing signals of fragment ions from more than one parent ion species, and the fragment ions being produced on the flight path before the reflector, (b) the mixed time-of-flight spectra are compared with each other in order to thus identify the signals of those fragment ions which originate from one parent ion species and one signal originating from the same fragment ion species is chosen in each of two mixed time-of-flight spectra, and (c) the mass-to-charge ratios of the fragment ion and the associated parent ion are determined as the solution of the following equations:

$$T_1=\mathrm{Sys}(m/q_m,M/q_M,P_1)$$

$$T_2=\mathrm{Sys}(m/q_m,M/q_M,P_2),$$

where M and $q_M$ are the mass and the charge of the parent ion, respectively; m and $q_m$ the mass and the charge of the fragment ion, respectively; $T_1$ and $T_2$ the times of flight of the two signals of the fragment ion species determined from the mixed time-of-flight spectra; $P_1$ and $P_2$ the values of the changed instrument parameter which are used in the acquisition of the time-of-flight spectra; and Sys is the system function of the time-of-flight mass spectrometer which gives the time of flight of a fragment ion as a function of the instrument parameter, and the mass-to-charge ratio of the fragment ion and the associated parent ion.

2. The method according to claim 1, wherein, after the reflector, the ions pass through an acceleration region or a second flight path, both being shorter than the flight path before the reflector, and are then detected in the ion detector.

3. The method according claim 1, wherein the fragment ions in the flight path before the reflector are formed by the decomposition of metastable parent ions and/or are generated there from the parent ions in a fragmentation cell.

4. The method according to claim 1, wherein the several parent ion species are selected from a larger number of ionic species.

5. The method according to claim 1, wherein the ion source uses an ionization by matrix-assisted laser desorption (MALDI).

6. A method for the mass spectrometric measurement of fragment ions with a time-of-flight mass spectrometer which contains an ion source, a flight path, a reflector and an ion detector, wherein (a) at least two mixed time-of-flight spectra are acquired with an instrument parameter which is different in each case, the mixed time-of-flight spectra containing signals of fragment ions from more than one parent ion species, and the fragment ions being produced on the flight path before the reflector, (b) the mixed time-of-flight spectra are compared with each other in order to thus identify the signals of those fragment ions which originate from one parent ion species and one signal originating from the same fragment ion species is selected in each of several mixed time-of-flight spectra, and (c) the mass-to-charge ratios of the fragment ion and the associated parent ion are determined as parameters of the regression for $T_i=\mathrm{Sys}(m/q_m,M/q_M,P_i)$, where M and $q_m$ are the mass and the charge of the parent ion, respectively; m and $q_m$ the mass and the charge of the fragment ion, respectively; $T_i$ the times of flight of the signals of the fragment ion species determined from the mixed time-of-flight spectra; $P_i$the values of the instrument parameter which are used in the acquisition of the time-of-flight spectra; and Sys is the system function of the time-of-flight mass spectrometer which gives the time of flight of a fragment ion as a function of the instrument parameter, and the mass-to-charge ratio of the fragment ion and the associated parent ion.

7. The method according to claim 6, wherein, after the reflector, the ions pass through an acceleration region or a second flight path, both being shorter than the flight path before the reflector, and are then detected in the ion detector.

8. The method according claim 6, wherein the fragment ions in the flight path before the reflector are formed by the decomposition of metastable parent ions and/or are generated there from the parent ions in a fragmentation cell.

9. The method according to claim 6, wherein the several parent ion species are selected from a larger number of ionic species.

10. The method according to claim 6, wherein the ion source uses an ionization by matrix-assisted laser desorption (MALDI).

11. A method for the mass spectrometric measurement of fragment ions with a time-of-flight mass spectrometer which contains an ion source, a flight path, a reflector and an ion detector, wherein (a) a mixed time-of-flight spectrum is acquired which contains signals of fragment ions of more than one parent ion species, and the fragment ions are produced on the flight path before the reflector, (b) two signals $S_1$ and $S_2$ in the isotopic pattern of a fragment ion are selected and their times of flight $T_1$ and $T_2$ are determined from the mixed time-of-flight spectrum, and (c) the mass-to-charge ratios of the fragment ion and the associated parent ion are calculated as the solution of the following equations:

$$T_1=\mathrm{Sys}(m/q_m,M/q_M)$$

$$T_2=\mathrm{Sys}((m+n\cdot\mathrm{Da})/q_m,(M+n\cdot\mathrm{Da})/q_M),$$

where M and $q_M$ are the mass and the charge of the parent ion, respectively; m and $q_m$ the mass and the charge of the fragment ion, respectively; the selected isotopes have a mass difference of n dalton; and Sys is the system function of the time-of-flight mass spectrometer which gives the time of flight of a fragment ion as a function of the mass-to-charge ratio of the fragment ion and the associated parent ion.

12. A method for the mass spectrometric measurement of fragment ions with a time-of-flight mass spectrometer wherein the total flight path consists of a field-free flight path and the reflector, which has a quadratically increasing decelerating potential, and thus the system function is given by the following equation:

$$T(M_p, m_{p,d}) = c_1 \cdot \sqrt{\frac{M_p}{2q_M U_B}} + c_2 \cdot \sqrt{\frac{m_{p,d}}{2q_m U_C}},$$

where $M_p$ and $q_M$ are the mass and the charge of the parent ion, respectively; $m_{p,d}$ and $q_m$ the mass and the charge of the fragment ion, respectively; $U_B$ is the accelerating voltage of an acceleration region before the field-free flight path; and $U_C$ is the deceleration voltage at the reflector, and wherein:

(a) at least two mixed time-of-flight spectra are acquired with an instrument parameter which is different in each case, the mixed time-of-flight spectra containing signals of fragment ions from more than one parent ion species, and the fragment ions being produced on the flight path before the reflector, and (b1) the mixed time-of-flight spectra are compared with each other in order to thus identify the signals of those fragment ions which originate from one parent ion species, and/or (b2) the times of flight of a fragment ion species in the mixed time-of-flight spectra are determined and used to calculate the mass-to-charge ratios of the fragment ion and the associated parent ion.

13. The method according to claim 12, wherein two mixed time-of-flight spectra with different accelerating voltages are acquired and compared, where all signals in the second mixed time-of-flight spectrum which have the same time-of-flight delay ΔT as the first mixed time-of-flight spectrum are determined as originating from one parent ion species.

14. The method according to claim 13, wherein, in addition, two time-of-flight spectra are acquired which contain only signals of parent ions and for which the accelerating voltages of the two mixed time-of-flight spectra are used, and the signals in the second mixed time-of-flight spectrum which have the same time-of-flight delay ΔT as the first mixed time-of-flight spectrum are assigned to the parent ion species which has the same time-of-flight delay ΔT in the time-of-flight spectra.

15. The method according to claim 12, wherein two mixed time-of-flight spectra are acquired using different accelerating voltages, said spectra containing signals of the associated parent ions also; and in the second mixed time-of-flight spectrum, those signals are determined which have the same time-of-flight delay ΔT as the first mixed time-of-flight spectrum, the signal with the longest time of flight is assigned to the parent ion species, and the other signals are assigned to the fragment ions which originate from this parent ion species.

16. The method according to claim 12, wherein the time-of-flight delays of the fragment ions which originate from different parent ion species are determined by means of a cross correlation between the first and the second mixed time-of-flight spectra.

17. The method according to claim 12, wherein the ion source uses an ionization by matrix-assisted laser desorption (MALDI).

18. The method according claim 12, wherein the fragment ions in the flight path before the reflector are formed by the decomposition of metastable parent ions and/or are generated there from the parent ions in a fragmentation cell.

19. The method according to claim 12, wherein the reflector has a potential distribution of a Cassini ion trap for decoupled oscillations of the ions in the longitudinal direction and the lateral direction.

20. The method according to claim 12, wherein the several parent ion species are selected from a larger number of ionic species.

21. The method according to claim 12, wherein at least one mixed time-of-flight spectrum has additional signals of the parent ions, and the signals of those fragment ions which originate from one parent ion species are assigned to the corresponding parent ion species by comparing the mixed time-of-flight spectra.

* * * * *